US005388910A

United States Patent [19]

Koyanagi

[11] Patent Number: 5,388,910

[45] **Date of Patent: * Feb. 14, 1995**

[54] BAG WITH A FILTERING CHECK VALVE

[75] Inventor: Yoshihiro Koyanagi, Osaka, Japan

[73] Assignee: Kabushikikaisha Kashiwaraseitai, Osaka, Japan

[ * ] Notice: The portion of the term of this patent subsequent to May 11, 2010 has been disclaimed.

[21] Appl. No.: 966,886

[22] Filed: Oct. 27, 1992

[30] Foreign Application Priority Data

Nov. 1, 1991 [JP] Japan ..... 3-98482[U]

[51] Int. Cl.[6] ..... B65D 33/01

[52] U.S. Cl. ..... 383/100; 383/102; 383/103; 426/395; 426/106

[58] Field of Search ..... 426/106, 395; 383/100, 383/102, 103, 44, 45

[56] References Cited

U.S. PATENT DOCUMENTS

| | | | |
|---|---|---|---|
| 3,399,822 | 9/1968 | Kugler | 383/103 |
| 4,310,118 | 1/1982 | Kisida et al. | 383/102 |
| 4,708,167 | 11/1987 | Koyanagi | 137/512.15 |
| 5,209,264 | 5/1993 | Koyanagi | 137/852 |

FOREIGN PATENT DOCUMENTS 2105877 8/1990 Japan .

*Primary Examiner*—Michael W. Ball
*Assistant Examiner*—Richard Crispino
*Attorney, Agent, or Firm*—Larson and Taylor

[57] ABSTRACT

A bag fabricated of plastic film and particularly suited for holding pulverulent or granular food products, such as rice, is provided with a check valve which is also fabricated of plastic film. The check valve includes a filter surface located in the fluid flow path of the check valve. The check valve allows egress of air or other fluid from the bag and prevents ingress of air into the bag, while the filter serves to retain the bag contents within the bag.

3 Claims, 5 Drawing Sheets

BAG WITH A FILTERING CHECK VALVE

BACKGROUND OF THE INVENTION

The present invention relates to an improvement of a bag for containing therein food which has to be stored under good conditions, For instance grains such as rice grains, and other pulverulent or granular foods liable to generate fluid such as gases during storage in the bag, and being able to discharge only Fluid such as excessive air From the bag and to prevent the outside air From entering into the bag.

In order to improve storge and minimize the bulkiness of the contained foods, there have been developed and proposed in the past varions kinds of food containing bags having a check valve and in which fluid such as air in the bag is discharged for lowering the pressure in the bag to a reduced pressure. The subject of such development, however, was directed solely to bag body and the function of the check valve was to simply discharge the fluid residing in the bag outside and to prevent outside air from entering into the bag.

Though it was possible, with such conventional food containing bags having a check valve, to discharge the fluid residing in the bag outside and to prevent outside air from entering into the bag by means of said check valve, there was a problem that it was unavoidable that a part of the contained food escapes out through a flow path in the check valve when inside fluid in discharged. This possiblity of escape of the food is remarkable when the food is pulverulent or granular.

SAMMARY OF THE INVENTION

The present invention was made to eliminate said problem of the previously known food containing bags, and it is an object of the present invention to provide a food containing bag in which when the fluid in the bag is discharged, the escape of the contained Food through the flow path in a check valve may be positively and effectively prevented even if the food is fine pulverulent or granular.

In order to accomplish said object, the food containing bag acccording to the present invention comprises a bag body made of a plastic film for containing Food therein, a check valve made of a plastic film and mounted in an edge portion of said bag body for discharging fluid from said bag body, the interior and the exterior of said bag body communicating with each other only through a fluid discharge path of said check valve, and through a filtering surface provided in a portion of said check valve inserted into said bag body, the filtering surface being located in said fluid discharge path.

According to another preferable feature of the present invention, said check valve comprises a first plastic film (1); a filtering second plastic film (2) having fine holes, a third plastic film (3) and a fourth plastic film (4) which are each shorter than said first plastic film (1) respectively and arranged in this order on one surface of said first plastic film (1); the lower edges and the right and left side edges of said first and second plastic films (1) and (2) are joined together to define a fluid discharge path (7) therebetween and a valve seat portion (1*a*) in the upper portion of said first plastic film (1); the lower edges of said third and fourth plastic films (3) and (4) are joined to said second plastic film (2) at its portion between its upper and lower edges and the right and left side edges of said third and fourth plastic films (3) and (4) are joined to the right and left side edges of said second plastic film (2) to define an upper opening (5) between said first and fourth plastic films (1) and (4), a checking flap (3*a*) in the portion of said third plastic film (3) which extends upwardly beyond the upper edge of said second plastic film (2) for cooperation with said valve seat portion (1*a*) of said first plastic film (1), and a pocket (9) between said third and fourth plastic films (3) and (4) for pressing said checking flap (3*a*) against said valve seat portion (1*a*), and the portion of said second plastic film (2) which is lower than the lower edges of said third and fourth plastic films (3) and (4) being located in said fluid discharge path (7) and exposed for functioning as a filtering surface (2*a*).

According to a further preferable feature of the present invention, said fourth plastic film (4) is made longer than said third plastic film (3) so that the upper portion of the fourth plastic film (4) extends upwardly beyond the upper edge of the third plastic film (3), and the third plastic film (3) is thinner than the fourth plastic film (4).

According to a still further preferable feature of the present invention, a partial joining portion (10) is provided in said upper opening (5) to make narrow the fluid flow path.

The food containing bag according to the present invention is constructed as above described so that when the bag body (A) is pressed from outside after having contained therein pulverulent or granular grain (C) such as rice grain or adzuki bean and having sealed the bag body (A), the air in the bag body [residual air and breathing air of the grain (C)] is effectively discharged, as shown in FIG. 6, through the fine holes or openings in the substantially large filtering surface (2*a*) of said filtering second plastic film (2) into said discharge path (7) and then smoothly discharged outside the bag body (A) through the upper opening (5). At this time, the grain (C) does not escape from the bag body (A) because it is obstructed by said second plastic film (2).

When the pressure in the bag body (A) has been lowered to a reduced pressure by the discharge of air, the outside air tends to flow backward into the bag body (A) through said upper opening (5) of the check valve (B). At this time, however, outside air flows into said pocket (9) to press said checking flap (3*a*) against said valve seat portion (1*a*) to thereby close said discharge path (7), reliably preventing outside air from flowing into the bag body (A).

DESCRIPTION OF THE PREFERRED EMBODIMENT

Figure 1:
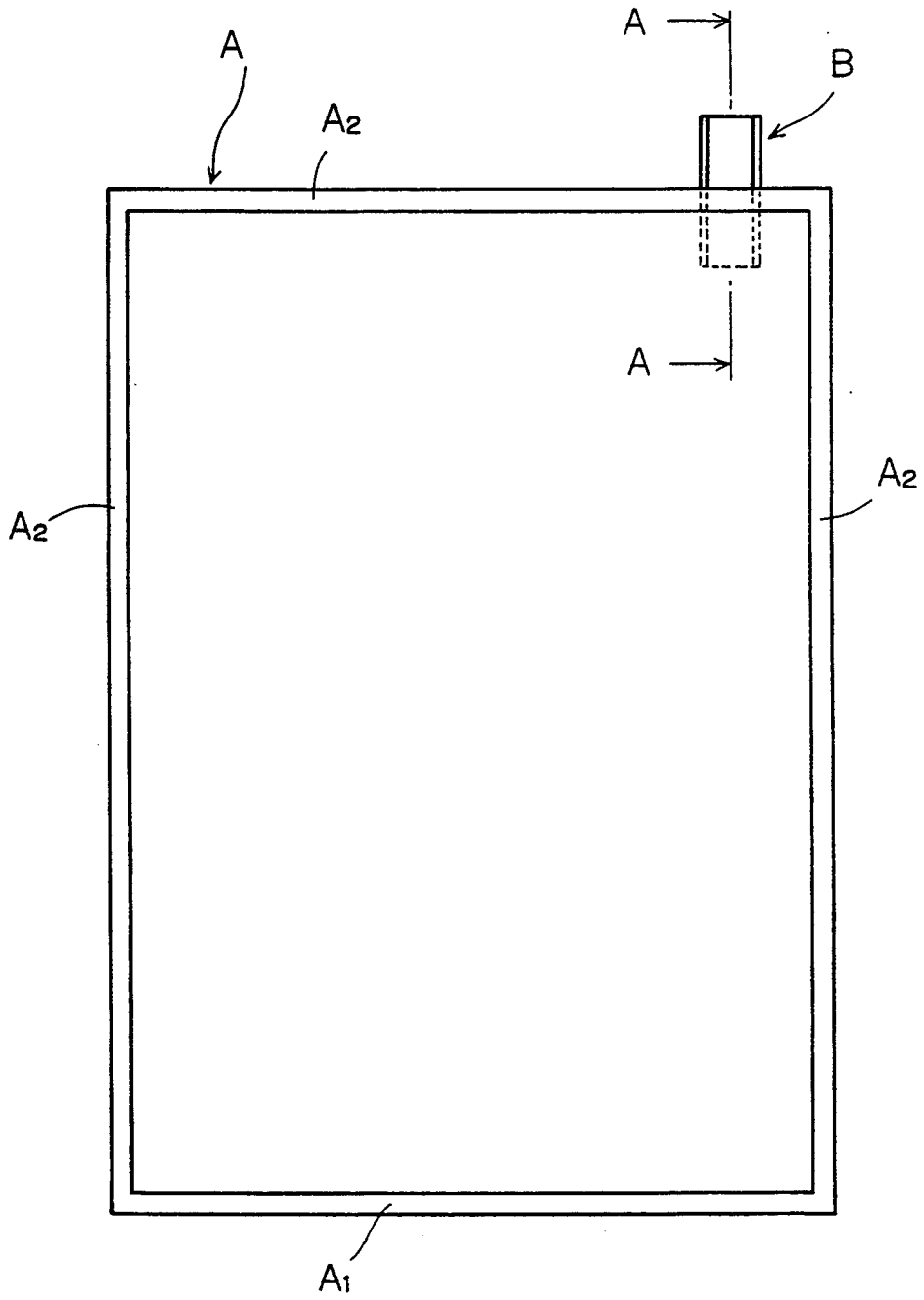
FIG. 1 is a front elevational view of a food containing bag according to the present invention.
Figure 2:
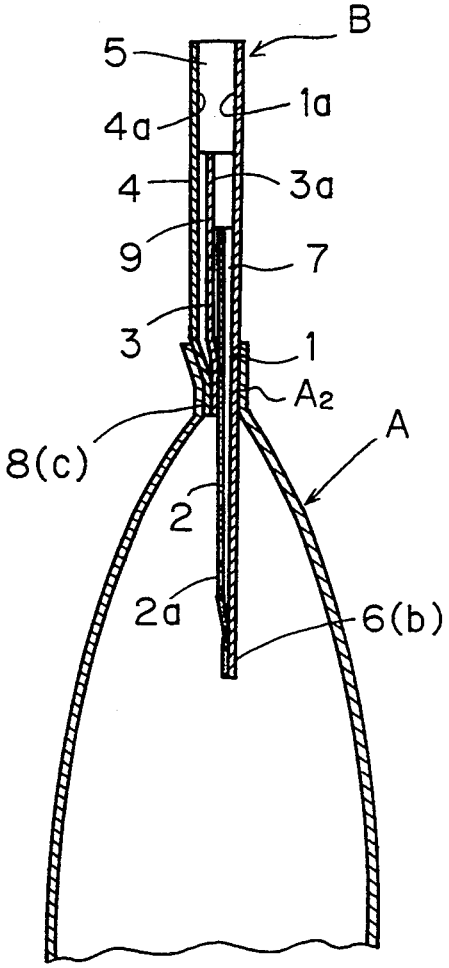
FIG. 2 is an enlarged sectional view taken along the line A—A of FIG. 1.

Reffering now to the drawings, there is shown an embodiment of a food containing bag according to the present invention. A food containing bag according to the present invention comprises a bag body (A) comprising a grain bag made of extremely impermeable rectangular plastic films and a flat check valve (B) made of plastic films and mounted in one edge portion of the bag body (A) for discharging air from the bag body (A). The bag body (A) has an opening ($A_1$) in the lower edge portion thereof for charging grain (C) into the bag body (A). The remaining three edge portions ($A_2$) are heat-sealed and when such heat-sealing is effected, the lower portion of the check valve (B) is inserted into the bag body (A) while the upper portion of the check valve (B) projects outwardly, and the check valve (B) is integrally adhered and secured to the bag body (A).

The check valve (B) comprises a heat-bonding first plastic film 1 of longitudinally elongate rectangular shape, and a filtering second plastic film 2 of a heat-bonding nonwoven plastic fabric having a number of fine holes. The second plastic film 2 has the same width as the first plastic film 1 but is a little shorter than the latter. The check valve B further comprises a heat-bonding thinner plastic film 3 having the same width as the first plastic film 1 but which is substantially shorter than the latter, and a heat-bonding fourth plastic film 4 having the same width and thickness as the first plastic film 1 but which is shorter than the first, plastic film 1 and longer than the third plastic film 3.

Said second plastic film 2 is laid on one side of said first plastic film 1 with the lower edges of these films being trued up or aligned with each other. Said third and fourth plastic films 3 and 4 are laid on the second plastic film 2 with the lower edges of the films 3 and 4 being trued up each other and placed between the upper and lower edges of the film 2, typically about midway between these edges of the film 2. The films 1, 2, 3 and 4 as superposed in this order form a lamination of four plastic films.

The right and left side edges of said film lamination are heat-bonded together to form seal portions a and a, the lower edges 6 of the first and second plastic films 1 and 2 are heat-bonded together to form a seal portion b, and the lower edges 8 of the third and fourth plastic films 3 and 4 are heated so as to heat-bond together the second, third and fourth plastic films 2, 3 and 4 but not the first plastic film 1, at the lower edges 8 of the third and fourth plastic films 3 and 4 to form a seal portion c.

Figure 3:
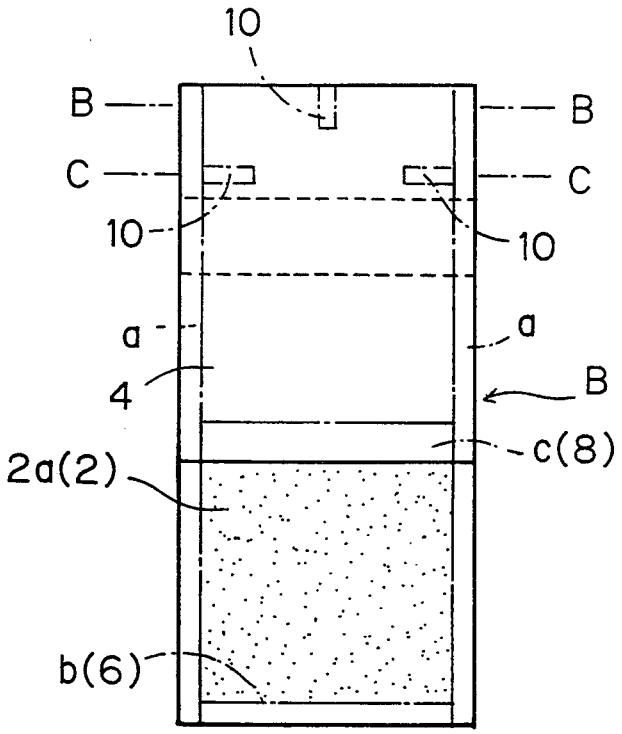
FIG. 3 is an enlarged Front elevational view of a check valve used in the present invention.
Figure 4:
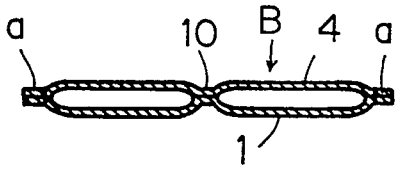
FIG. 4 is a sectional view taken along the line B—B of FIG. 3.
Figure 5:
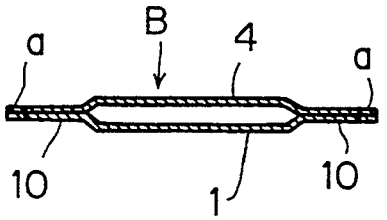
FIG. 5 is a sectional view taken along the line C—C of FIG. 3.

In this way, due to the differences in the lengths of plastic films 1, 2, 3 and 4 and due to the selection of the bonding or joining positions, there are formed an upper opening 5 between the first and fourth plastic films 1 and 4, a valve seat portion 1*a* in the upper portion of the first plastic film 1, a fluid discharge path 7 between the first and second plastic films 1 and 2, a checking flap 3*a* in that upper portion of the third plastic film 3 which extends upwardly beyond the upper edge of the second plastic film 2 for cooperation with said valve seat portion 1*a* of the first plastic film 1, and a pocket 9 between the third and fourth plastic films 3 and 4 for pressing said checking flap 3*a* against said valve seat portion 1*a* into intimate contact with the valve seat portion 1*a*. The upper portion 4*a* of the fourth plastic film 4 extends upwardly beyond the upper edge of the third plastic film 3 and the portion of the second plastic film 2 lower than the lower edges 8 of the third and fourth plastic films 3 and 4 is exposed for functioning as a filtering surface or portion 2*a*. In FIG. 3, reference numeral 10 designates a partially heat-bonded portion in upper opening 5 for making the fluid flow path narrow.

The check valve B of the construction as described above is inserted into the bag body A for containing for instance rice grains and secured to the bag body A. The check valve B is inserted into the bag body A with the upper opening 5 of the check valve B being located outside the bag body A. The interior and the exterior of the bag body A are in communication with each other only through the fluid flow path of the check valve B so that the storing condition for the rice grains is improved.

The function of the food containing bag will now be described with reference to FIGS. 6 and 7.

The rice grains C are charged into the bag body A through its opening $A_1$ and then this opening $A_1$ is sealed. As described above, a substantial quantity of residual air exists in the bag body A in which the rice grains are contained and the rice grains generate air by breathing even after placement in the bag body A. By pressing the bag body A from the outside after the rice grains are charged into the bag body A or by inserting a sucking nozzle of a vacuum device (not shown in the drawings) into the discharge path 7 of the check valve B through the upper opening 5 and sucking air through the fluid discharge path 7, the air existing in the bag body A is lead along with other gases into the fluid discharge path 7 through the filtering surface 2*a* of the filtering second plastic film 2 and then discharged outside tile bag body A through the upper opening 5. The filtering surface 2*a* obstructs the escape of rice grains out of the bag body A so that there is no fear of the rice grains being released from the bag body A. When a plurality of rice bags are stacked for storing, tile air discharge is ceaselessly effected by being pressed by the weight of tile rice bags.

When the pressure inside the bag body A has been lowered to a reduced pressure by the discharge of air, the outside air tends to flow backward into the bag body A through the upper opening 5 and fluid discharge path 7. At the same time, however, the outside air certainly flows also into pocket 9 since the upper portion 4*a* of the fourth plastic film 4 extends upwardly beyond the upper edge of the third plastic film 3. The pressure of the air flows into the pocket 9 is exerted onto the checking flap 3*a* formed by thin plastic film 3 to intimately press the same against valve seat seat portion 1*a* as schematically shown in FIG. 7 to thereby close the outlet of the fluid discharge path 7. In this way, tile flow of the outside air backward into tile bag body A is positively prevented so that a reduced pressure is always maintained in the rice bag.

Furthermore, it is possible to secure a broad filtering surface 2*a* and it is also possible to make the filtering surface 2*a* broader or narrower. Therefore, the quantity of the air discharged from the rice bag per unit time may be most suitably adjusted, and clogging of the filtering surface 2*a* by the rice grains is reliably prevented.

The food containing bag according to the present invention is constructed and functions as described above so that it brings about the following various advantages.

After having charged food into the bag body, the fluid residing in the bag body may be discharged to lower the pressure in the bag body to a reduced pressure by simply pressing the bag body from outside so that the food may be stored for a long period of time under reduced pressure or vacuum by an simple operation.

Even if the fluid residing in the bag body is not positively discharged as described above, the fluid is discharged from the food contained bags by the weight thereof when these bags are stacked, and, therefore, a number of bags containing therein grains such as rice may be stably stacked and stored, and transported easily.

Furthermore, the interior and the exterior of a bag containing food therein are in communication with each other only through a filtering surface and a fluid discharge path of the check valve so that by selecting the size of the filtering holes in the Filtering plastic film smaller than the size of the food, only unnecessary gases or liquids may be discharged from the bag body while the food is maintained in the bag body without being released.

Still further, the filtering function of the filtering surface of the check valve, in contrast to the conventional check valve, is assured in the present invention by a substantially broad filtering surface, and the filtering surface does not become clogged or blocked entirely by the food contained in tile bag body. Accordingly discharge of fluid from tile bag body may be effected smoothly without any difficulty either when the bag body is pressed from outside or the air in the bag is sucked by using vacuum device.

Figure 6:
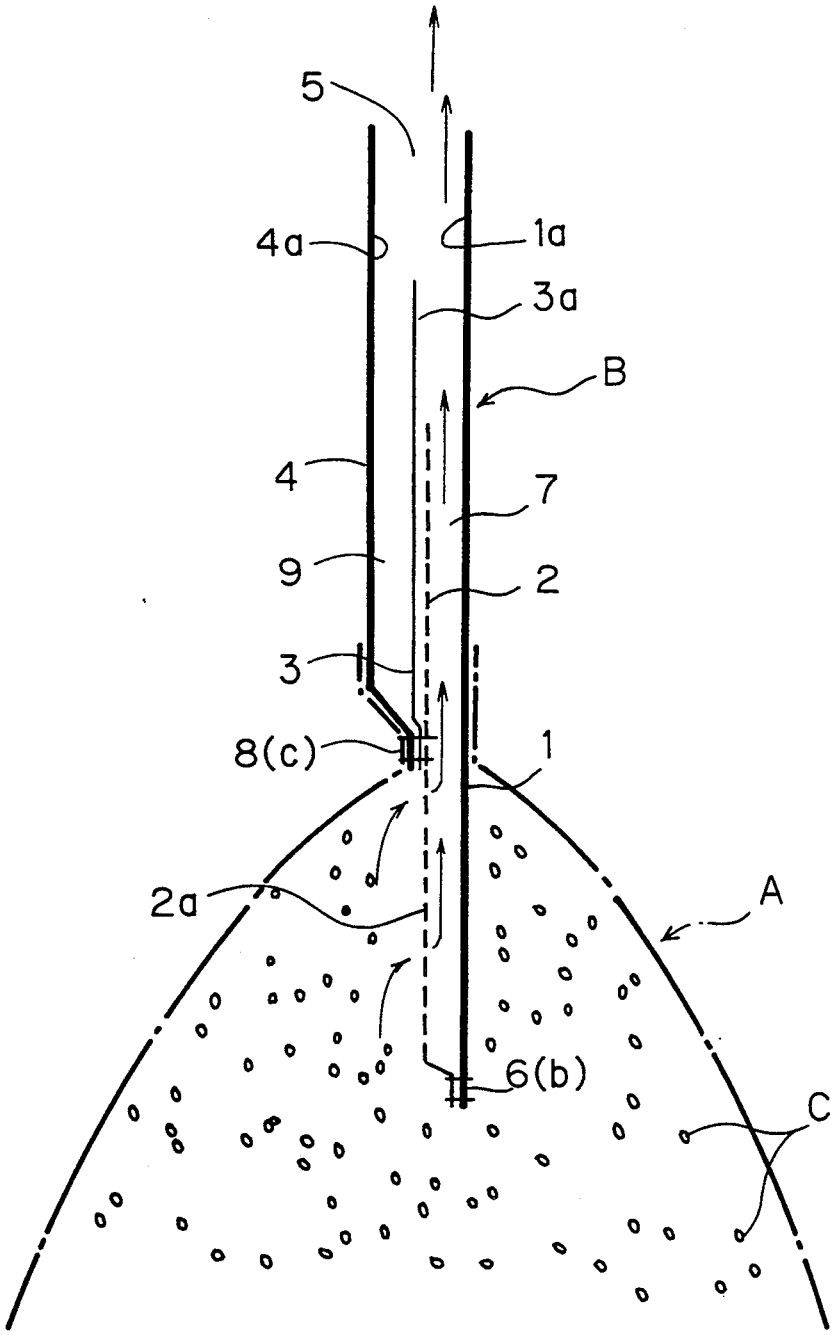
FIG. 6 is a schematical sectional view of check valve showing how it discharges the fluid residing in the bag body.
Figure 7:
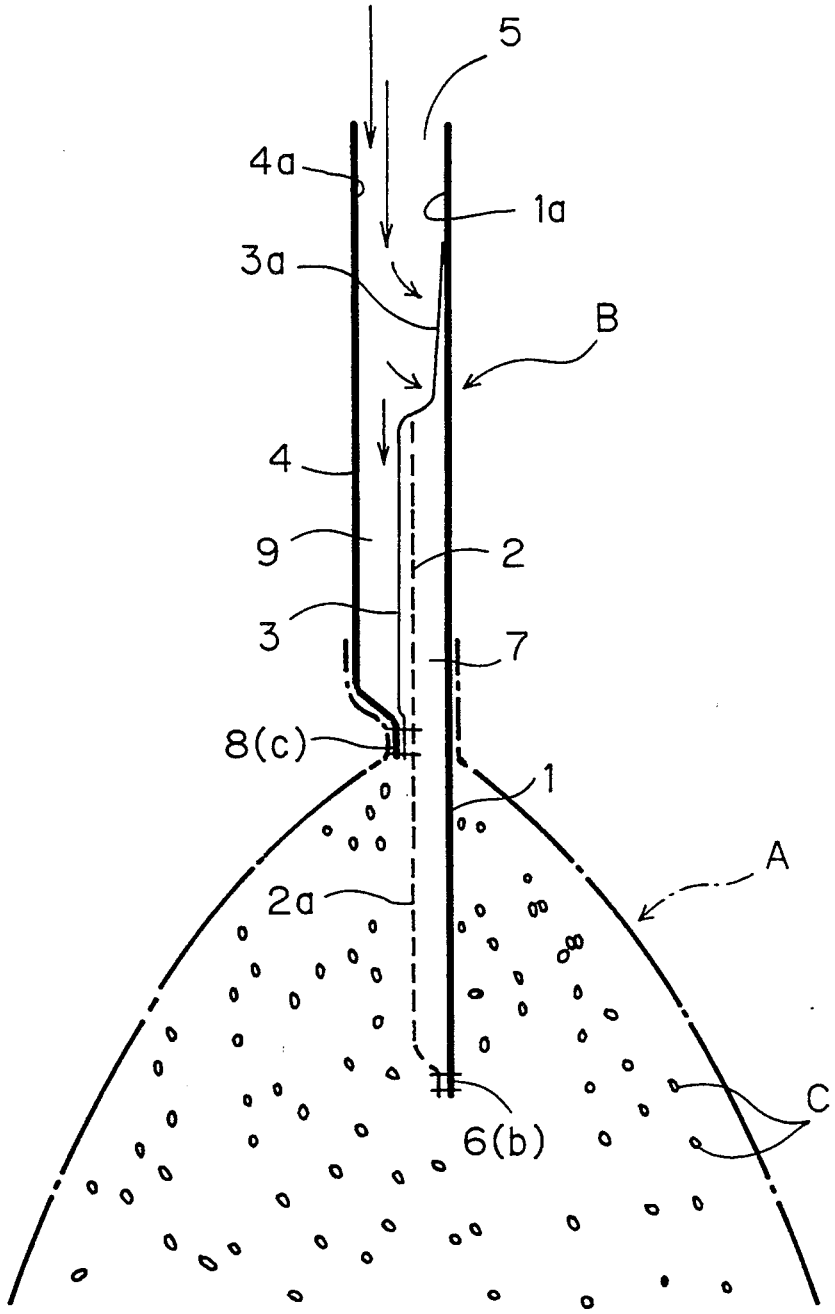
FIG. 7 is a schematical sectional view of the check valve showing how it prevents outside air from flowing into the bag body.

Futhermore, according to the construction of FIG. 6, by the provisions of the pocket for actuating the checking flap which cooperates with tile valve seat portion in the discharge path, even if conditions favor the flow of outside air backward into the bag body, the air which flows into the pocket quickly presses the checking flap intimately against the valve seat portion to thereby close the outlet of the discharge path so that there is no fear of tile outside air flowing into the bag body and there is no affect on the contained food by the outside air.

While the present invention has been described with reference to a preferred embodiment, it is to be distinctly understood that the invention is not limited thereto but may be modified without departing from the spirit of the invention. For instance, the food containing bag may be used to store under sealed condition various kinds of foods including grains other than rice grains and other foods. Furthermore, tile filtering plastic film of the check valve may be formed by other material than tile nonwoven plastic fabric. The bag body may be formed by a plastic film on which a metal such as alumimum foil is laminated.

What is claimed is:

1. A bag comprising a bag body made of a plastic film for containing food therein;

a flat, elongate check valve mounted in a sealed edge portion of said bag body for discharging fluid from said bag body, a first portion of said flat elongate check valve extending into the bag body and a second portion of said flat, elongate check valve extending outside of said bag body, the interior and the exterior of said bag body communicating with each other only through a fluid discharge path of said check valve;

a filtering surface in said first portion of said check valve, said filtering surface being located in said fluid discharge path in said first portion of said check valve;

said check valve comprising:

a first plastic film;

a filtering second plastic film having fine holes;

a third plastic film; and a fourth plastic film, said third and fourth plastic films being shorter than said first plastic film, said second, third and fourth plastic films being superposed in this order on one surface of said first plastic film, each of said first, second, third and fourth plastic films having upper, lower, right side and left side edges;

the lower edges and the right and left side edges of said first and second plastic films and being joined together to define said fluid discharge path therebetween, said first plastic film having a valve seat portion in an upper portion thereof;

the lower edges of said third and fourth plastic films and being joined to said second plastic film between the upper and lower edges of said second plastic film such that a portion of said second plastic film extends below the lower edges of said third and fourth plastic films, and the right and left side edges of said third and fourth plastic films and being joined to the right and left side edges of said second plastic film to define an upper opening between said first and fourth plastic films, to define a checking flap in a portion of said third plastic film which extends upwardly beyond the upper edge of said second plastic film for cooperation with said valve seat portion of said first plastic film, and to define a pocket between said third and fourth plastic films for pressing said checking flap against said valve seat portion, and said portion of said second plastic film which extends below the lower edges of said third and fourth plastic films being located in said fluid discharge path for functioning as said filtering surface therein.

2. A bag as claimed in claim 1, wherein said fourth plastic film is made longer than said third plastic film so that an upper portion of the fourth plastic film extends upwardly beyond the upper edge of the third plastic film, and the third plastic film is thinner than the fourth plastic film.

3. A bag as claimed in claim 1, wherein a partial joining portion is provided in said upper opening to make narrow the fluid flow path.

* * * * *